US006769937B1

(12) United States Patent
Roberts

(10) Patent No.: US 6,769,937 B1
(45) Date of Patent: Aug. 3, 2004

(54) MODULAR JACK ASSEMBLY FOR JACK PLUGS WITH VARYING NUMBERS OF WIRES

(75) Inventor: James T. Roberts, Amherst, NH (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/436,915

(22) Filed: May 13, 2003

(51) Int. Cl.[7] ..... H01R 23/02
(52) U.S. Cl. ..... 439/676; 439/941
(58) Field of Search ..... 439/676, 941, 439/620, 637, 638, 490, 188

(56) References Cited

U.S. PATENT DOCUMENTS 5,938,479 A 8/1999 Paulson et al. ..... 439/676
6,079,996 A * 6/2000 Arnett ..... 439/188
6,210,237 B1 4/2001 Chang ..... 439/676
6,267,628 B1 7/2001 Meckley et al. ..... 439/676
6,280,256 B1 8/2001 Belopolsky et al. ..... 439/676
6,579,127 B2 * 6/2003 Hess et al. ..... 439/676

* cited by examiner

*Primary Examiner*—Alex Gilman
(74) *Attorney, Agent, or Firm*—Stephen Z. Weiss

(57) ABSTRACT

A modular jack assembly includes a dielectric housing means having a mating face. At least one conductive terminal has a body portion mounted in the housing and a contact arm cantilevered from the mating face. The contact arm has a contact portion near a distal end thereof for engaging a contact of a modular jack plug to flex the arm in a direction generally parallel to the mating face. The contact arm has an engaging portion located between the contact portion and the body portion. The housing has a first wall for engaging the engaging portion of the terminal and a second wall for engaging the contact portion of the terminal to prevent overflexing of the contact arm.

14 Claims, 9 Drawing Sheets

MODULAR JACK ASSEMBLY FOR JACK PLUGS WITH VARYING NUMBERS OF WIRES

FIELD OF THE INVENTION

This invention generally relates to the art of electrical connectors and, particularly, to a modular jack assembly for use in telecommunications equipment.

BACKGROUND OF THE INVENTION

Modular jack assemblies arc used in telecommunications equipment for mating with telephone-type modular plugs to transmit electrical signals therethrough. A typical modular jack assembly includes a dielectric housing having a receptacle for receiving the modular plug. A plurality of conductive terminals are mounted in the housing, with contact arms cantilevered into the receptacle. A conventional modular jack assembly includes at least eight terminals for engaging eight contacts of the modular plug. A simple eight-terminal modular jack assembly which mates with an eight wire plug is quite reliable and creates few problems.

However, some modular plugs contain only four or six wires, but the four or six wire plugs still are inserted into an eight-wire jack assembly. When this occurs, the outside terminals in an eight-terminal array in the jack assembly are prone to become damaged. This is due to the plastic ends of the plugs outside the four or six wire array contacting some of the jack terminals. The plastic ends cause the terminals to deflect excessively, resulting in a large rotating movement where the terminals are fixed to the jack housing. This large rotational movement causes the terminals to take a permanent set, and those damaged terminals no longer can apply sufficient pressure to the outside wires of a full eight wire modular plug. In addition, with the ever-increasing speed of data transmission, the reduction or elimination of crosstalk has become important for electrical connectors including modular jack assemblies. Crosstalk is a phenomena that occurs when a part of the electromagnetic energy transmitted through one of a plurality of conductors in a connector causes electrical currents in the other conductor or conductors. Various systems have been designed to prevent this crosstalk, such as passing the signals through over-line plates or through traces on a printed circuit board which create a capacitive connection. Heretofore, modular jack terminals have been provided with capacitive plates which were insert molded in the jack housing to maintain registration and location. However, this insert molding process requires a large capital investment.

Still other problems are encountered simply in mounting the tiny modular jack terminals in the very small jack housing. As stated, insert molding is quite expensive for an otherwise simple and inexpensive electrical connector. Mechanically inserting the terminals into the jack housing often results in damage to the tiny and very fragile terminals. The present invention is directed to solving this myriad of problems, including the provision of an eight terminal modular jack assembly which can receive modular plugs of a lesser number of contacts without damaging the jack terminals.

SUMMARY OF THE INVENTION

An object, therefore, of the invention is to provide a new and improved modular jack assembly of the character described.

In the exemplary embodiment of the invention, the modular jack includes a dielectric housing means having a mating face. At least one conductive terminal has a body portion mounted in the housing means and a contact arm cantilevered from the mating face of the housing means. The contact arm has a contact portion near a distal end thereof for engaging a contact of an appropriate mating connecting device, such as a modular plug, to flex the contact arm in a direction generally parallel to the mating face. The contact arm has an engaging portion located between the contact portion and the body portion. The housing means has a first wall for engaging the engaging portion of the terminal and a second wall for engaging the contact portion of the terminal to prevent overflexing of the contact arm. According to one aspect of the invention, the first and second walls of the housing means are generally parallel to each other and project generally perpendicular to the mating face of the housing means. The first wall projects form the mating face offset from the contact arm a first distance, and the second wall projects from the mating face offset from the contact arm a second distance.

According to another aspect of the invention, the engaging portion of the contact arm comprises a bowed portion defining a convex surface for engaging the first wall of the housing means. The contact portion of the contact arm comprises, at least in part, a bowed portion defining a convex surface for engaging the second wall of the housing means. The contact portion is bent back onto itself to define the convex surface at a back side of the contact arm, with a contact surface at a front side of the contact arm for engaging the contact of the mating plug.

According to a further aspect of the invention, the housing means include an inner terminal module body in which the terminal is mounted and which defines the mating face of the housing means. An outer housing defines at least one of the first and second walls. As disclosed herein, the first wall is provided on the inner terminal module body and the second wall is provided on the outer housing.

Finally, as disclosed herein, the modular jack assembly includes a linear terminal array on the housing means. At least one of the above-described conductive terminals is located at each opposite end of the linear terminal array.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
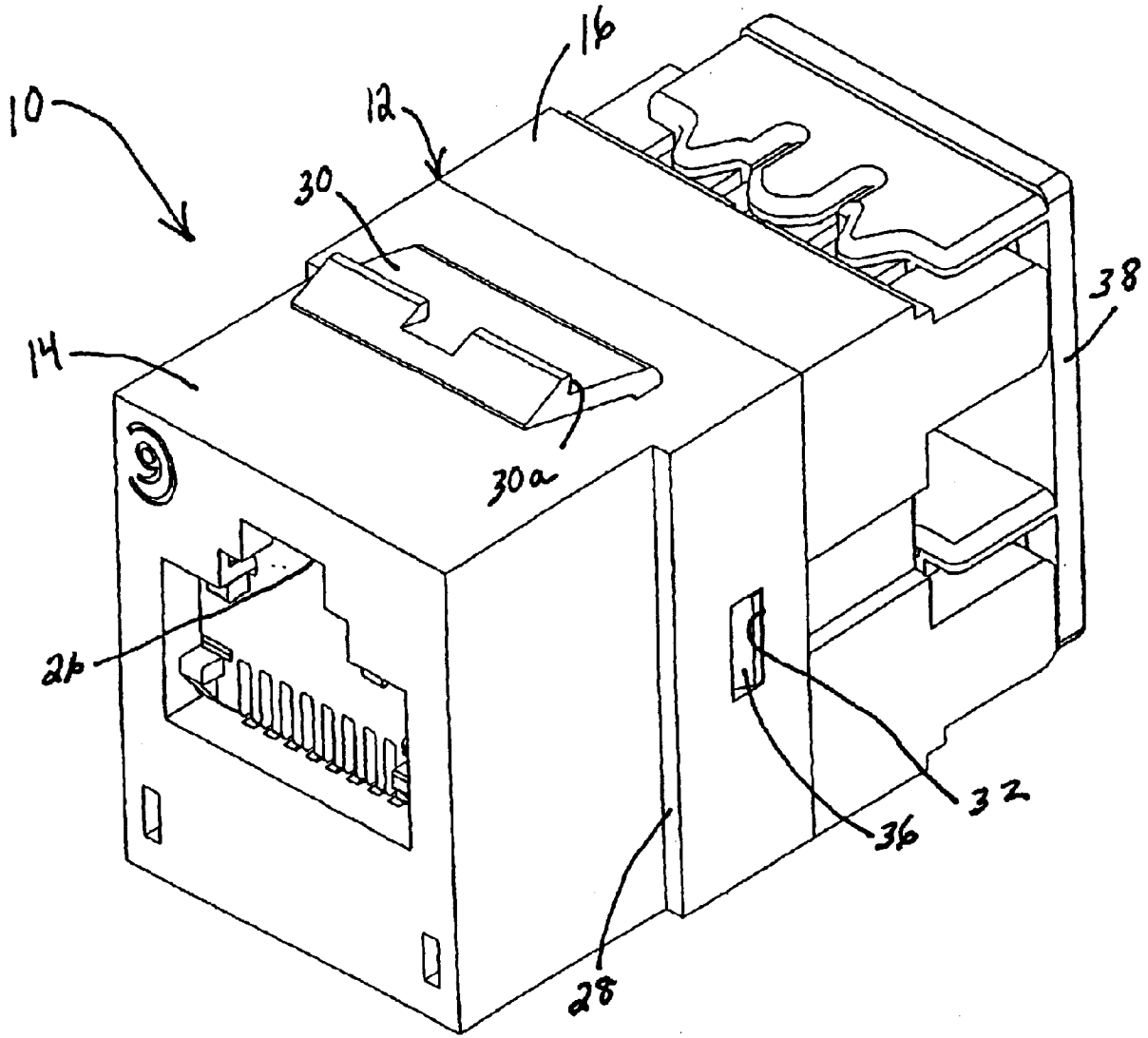
FIG. 1 is a front perspective view of a modular jack assembly incorporating the concepts of the invention.
Figure 2:
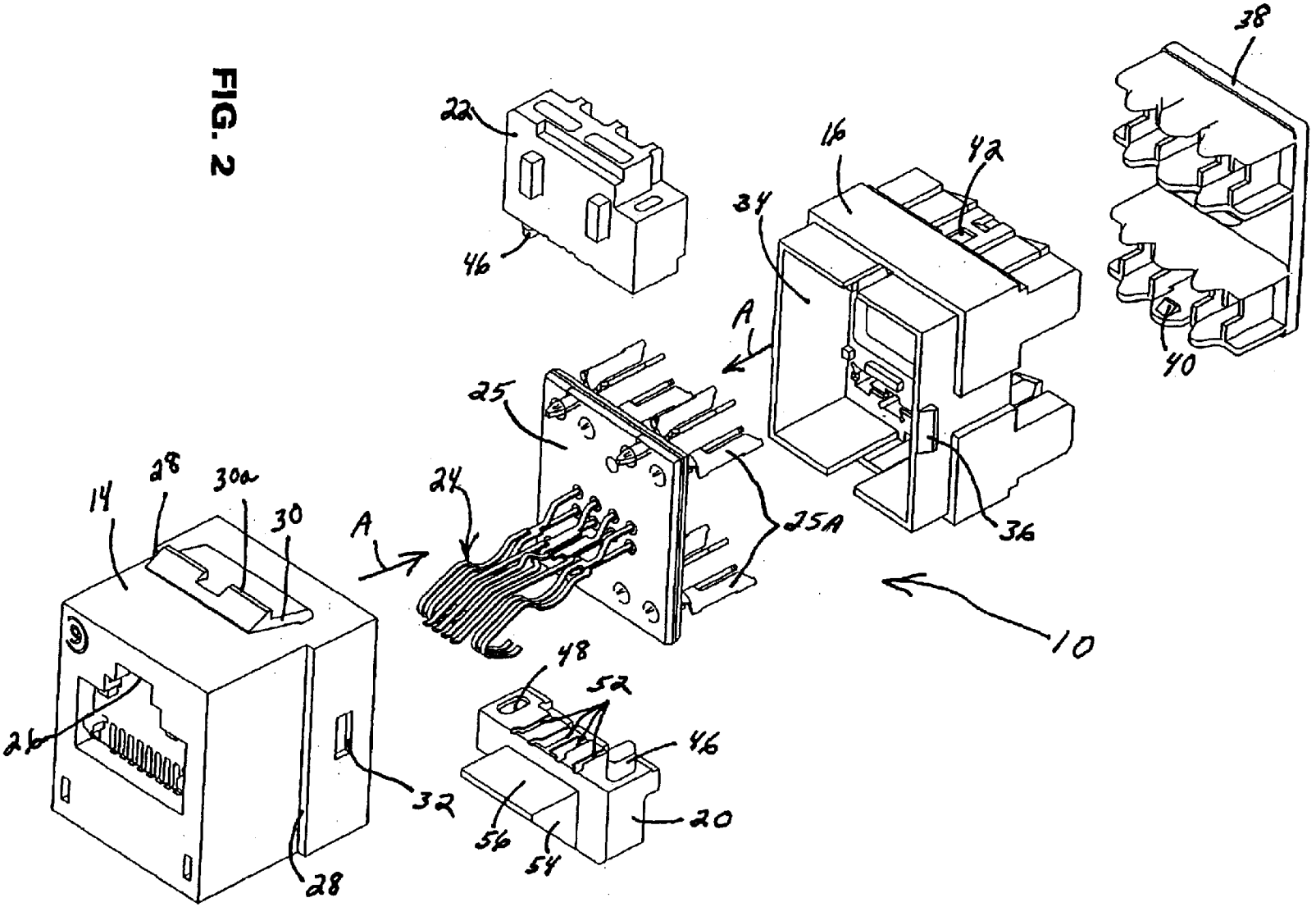
FIG. 2 is an exploded perspective view of the modular jack assembly.

Referring to the drawings in greater detail, and first to FIGS. 1 and 2, the invention is embodied in a modular jack assembly ("modular jack"), generally designated 10. The modular jack includes a dielectric housing means, generally designated 12 (FIG. 1), which is a two-part housing means provided by a front housing part 14 and a rear housing part 16. A terminal module, generally designated 18 in FIG. 5 and described in greater detail hereinafter, is mounted within the modular jack between front and rear housing parts 14 and 16, respectively. As viewed in FIG. 2 and described hereinafter, the terminal module includes a pair of body halves 20 and 22 which sandwich a plurality of terminals, generally designated 24, therebetween. As seen in FIG. 2, the terminals are mounted in a linear array. The terminals are inserted into a printed circuit board 25 having circuit traces which help to minimize crosstalk. A plurality of insulation-displacement terminals 25A are terminated to the circuit traces and project rearwardly from printed circuit board 25.

Front housing part 14 of housing means 12 includes a typically configured receptacle 26 for receiving a modular plug as is known in the telecommunications industry. The front housing part is constructed for mounting in a panel, circuit board or other substrate, with a flange 28 on each opposite side of the front housing part for engaging a back side of the panel. A flexible latch arm 30 includes a latch hook 30*a* for snappingly engaging the front side of the panel. The front housing part includes a latch opening 32 in each opposite side thereof.

Rear housing part 16 includes a cavity 34 for substantially receiving terminal module 18 with terminals 24 cantilevered forwardly into receptacle 26 of the first housing part whereby the terminals can engage the contacts of the mating modular plug. A pair of chamfered latch bosses 36 project outwardly from opposite sides of the rear housing part for engaging within openings 32 and latching the front and rear housing parts together surrounding the terminal module. Both housing parts may be fabricated of molded plastic material, whereby chamfered latch bosses 36 "snap" into latching engagement with latch openings 32 when the housing parts are assembled in the direction of arrow "A" (FIG. 2). A cover 38 closes the rear end of rear housing part 16. The cover includes a pair of inwardly facing chamfered latch bosses 40 for latching engagement in a pair of latch openings 42 in rear housing part 16. The cover manages or holds a plurality of discrete electrical wires for termination to insulation displacement terminals 25A.

Figure 3:
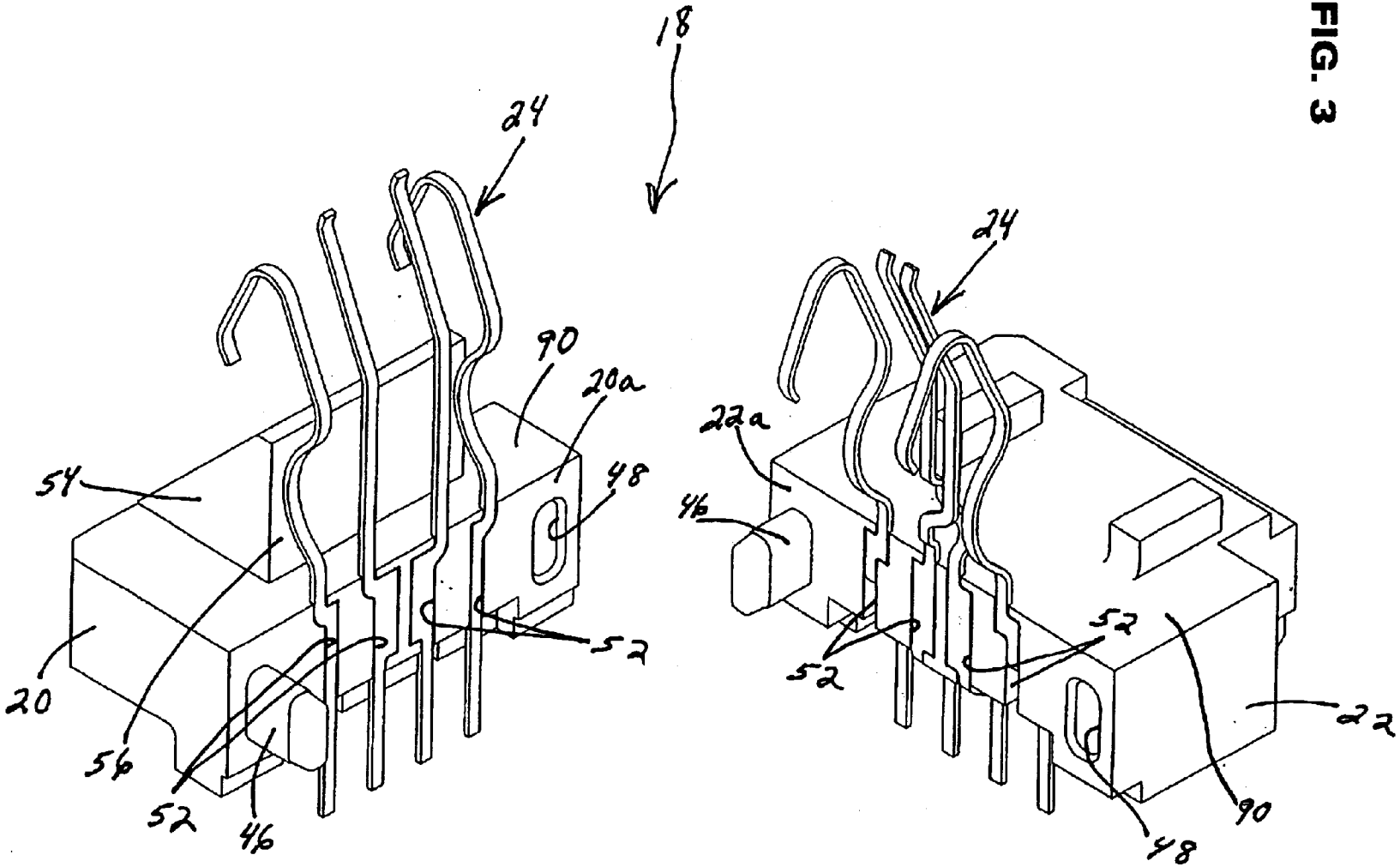
FIG. 3 is an exploded perspective view of the terminal module before the two-part terminal module body is assembled.
Figure 4:
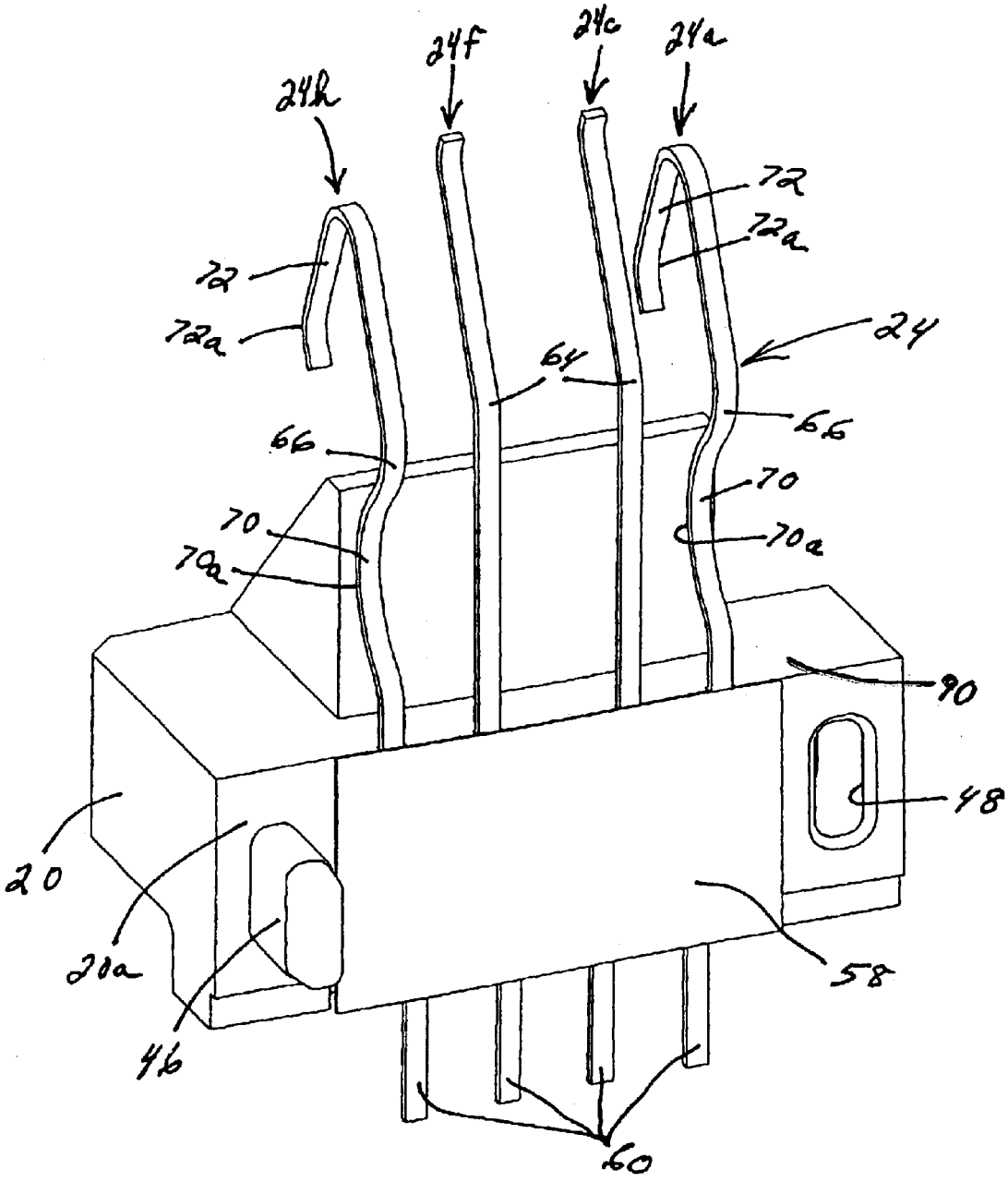
FIG. 4 is a perspective view of the left-hand terminal module body part as viewed in FIG. 3, with a dielectric sheet covering the terminals within the module.
Figure 5:
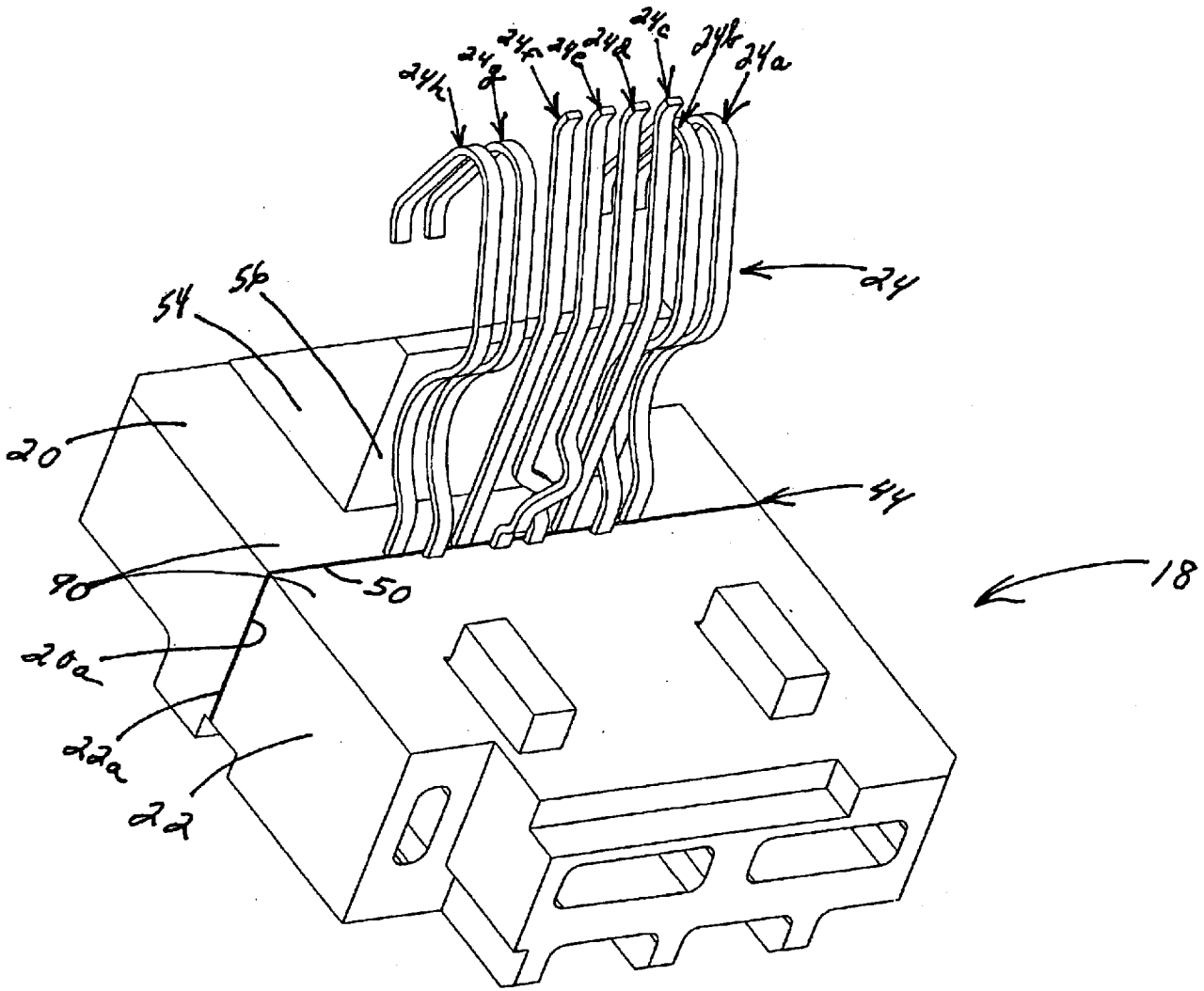
FIG. 5 is a perspective view showing the terminal module of FIG. 3 in assembled condition.
Figure 6:
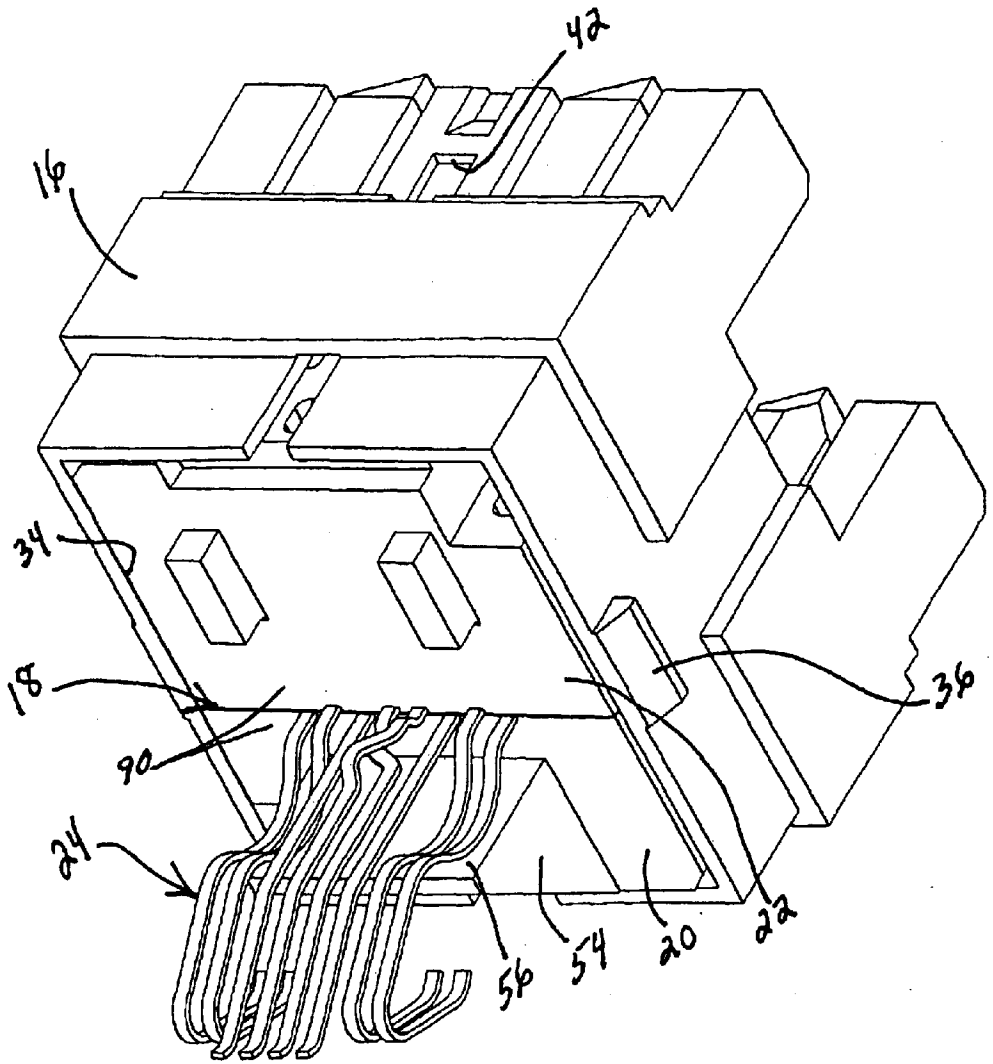
FIG. 6 is a perspective view of the terminal module mounted in the rear housing half of the modular jack assembly.

Referring to FIGS. 3–5, terminal module 18 includes a terminal module body, generally designated 44 (FIG. 5), which includes the aforementioned body halves 20 and 22. The "housing means" of modular jack assembly 10 includes terminal module body 44 (body halves 20 and 22) as well as front and rear housing parts 14 and 16, respectively. FIG. 5 shows the body halves secured together. FIG. 3 shows that each body halve has a securing post 46 which is press-fit into a securing hole 48 in the other body half. Body halves 20 and 22 have opposing abutting faces 20*a* and 22*a*, respectively, which abut each other at an interface 50 (FIG. 5) when the body halves are assembled. Each opposing abutting face of each body half includes a plurality of recesses 52 within which terminals 24 are press-fit before the body halves are press-fit together. Therefore, it can be seen that the entire terminal module is extremely simple and extremely efficient to manufacture and assembly by a simple press-fit concept To that end, FIG. 6 shows terminal module 18 mounted within cavity 34 in rear housing part 16. The cavity conforms to the outer peripheral dimensions of the terminal module, including the assembled body halves 20 and 22, so that the body halves cannot separate, thereby securely sandwiching terminals 24 between the body halves and securely mounting the terminals within rear housing part 16.

Both body halves 20 and 22 of terminal module 18 are molded of plastic material. For purposes described hereinafter, body half 20 is molded with a support block 54 projecting therefrom and defining a generally planar wall 56 which extends generally parallel to the linear array of terminals 24, for purposes described hereinafter.

Referring back to FIG. 4, a dielectric sheet 58 is adhered to face 20*a* of body half 20 covering the terminals. This dielectric sheet is effective to ensure that any portion of the terminals in one body half do not engage any portions of the terminals in the other body half when the body halves are press-fit together. As will be seen hereinafter, certain portions of the terminals overlap to create capacitive arrangements, and dielectric sheet 58 prevents engagement between the overlapping terminal portions. Of course, dielectric sheet 58 could be adhered to face 22*a* of body half 22 as well as or in the alternative to adhering the sheet to face 20*a* of body half 20.

Figure 7:
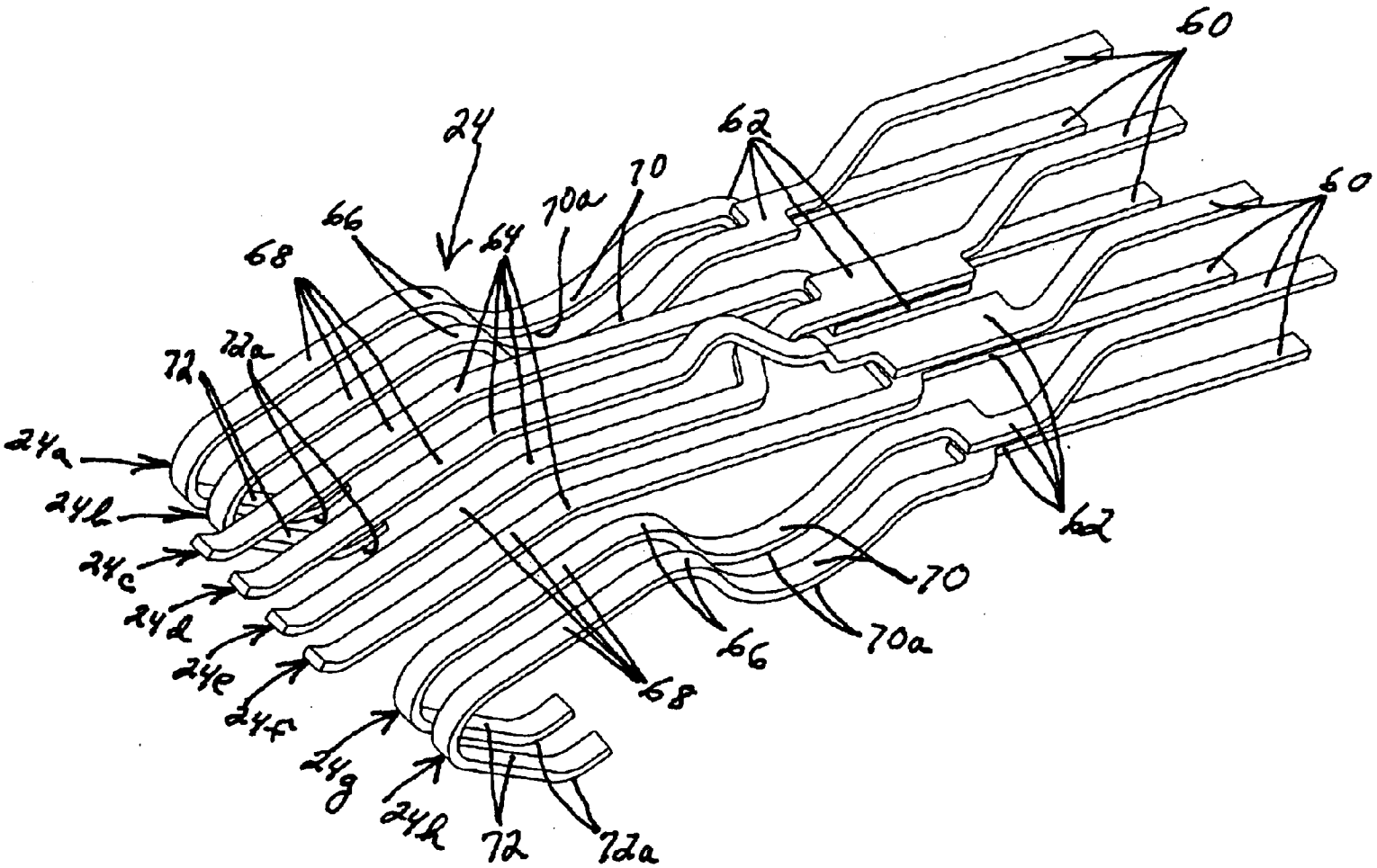
FIG. 7 is a perspective view of the terminals isolated from the modular jack assembly to show the overlapping relationship of portions of the terminals.

FIG. 7 shows terminals 24 in their generally linear array as seen above in FIGS. 2, 5 and 6. Actually, the terminals would never exist in this isolated depiction as well as in the depiction of FIG. 2, because the terminals are mounted within terminal module 18 between body halves 20 and 22 of the module. The depiction of FIG. 7 is to enable a clear description of the configurations of the terminals, below.

With that understanding, terminals 24 have been identified as individual terminals 24*a*–24*h* in sequence, from one end of the linear array of terminals to the opposite end. All of the terminals are stamped and formed of conductive sheet metal material and have tail portions 60 for insertion into printed circuit board 25 (FIG. 2). All of the terminals have enlarged or irregular body portions 62 forming mounting portions which are press-fit into recesses 52 in body halves 20 and 22 as seen in FIG. 3. The mounting portions of terminals 24 and 24*b* overlap. The mounting portions of terminals 24*c* and 24*d* overlap. The mounting portions of terminals 24*e* and 24*f* overlap. The mounting portions of terminals 24*g* and 24*h* overlap. These overlapping portions of the terminals create capacitive arrangements to reduce or eliminate crosstalk within the modular jack assembly. Dielectric sheet 58 (FIG. 4) is disposed between these overlapping portions of the terminals to prevent engagement therebetween.

The four inside terminals 24*c*–24*f* are provided with contact portions 64, and the four outside terminals 24*a*, 24*b*, 24*g* and 24*h* are provided with contact portions 66. All of the contact portions are provided for engaging contacts of a modular jack plug inserted into receptacle 26 (FIG. 1) of the modular jack assembly. The contact portions are bent out of contact arms 68 of the terminals, with the contact arms being cantilevered into receptacle 26. It can be seen in FIG. 7 that two pairs of terminals 24*a*/24*b* and 24*g*/24*h* are disposed outside the four inner terminals 24*c*–24*f*. The outside terminals have different configurations and include engaging portions 70 which are bowed to define convex surfaces 70*a*. Contact portions 66 of contact arms 68 of the outside terminals also are bowed, but in the opposite direction of bowed engaging portions 70, to define convex contact surfaces for engaging the contacts of the modular plug. In addition, the contact portion of each contact arm of each outside terminal is bent back onto itself, as at 72, to define a convex surface 72*a* at a back side of the contact arm. In other words, the convex surfaces defined by contact portions 66 are at a front side of the contact arms for engaging the contacts of the mating plug, while convex surfaces 72*a* are located at an opposite or back side of the contact arms.

Figure 8:
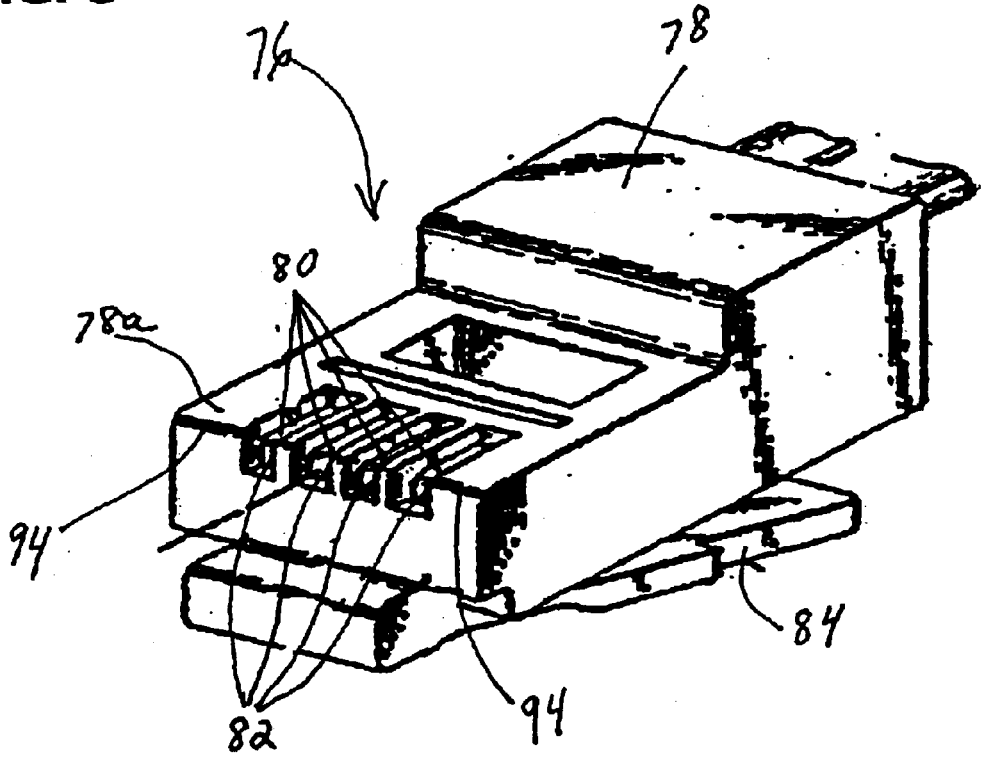
FIG. 8 is a perspective view showing the mating end of a four-wire modular plug for mating with the modular jack assembly.

FIG. 8 shows a typical modular jack plug, generally designated 76. The plug includes a dielectric housing 78 mounting a plurality of terminals which have contacts 80 exposed within a plurality of troughs 82 at one side 78*a* of the housing. The plug is inserted into receptacle 26 (FIG. 1) in modular jack assembly 10, and a flexible latch arm 84 on the plug latchingly engages with front housing part 14 inside the receptacle, as is known in the art.

Figure 9A:
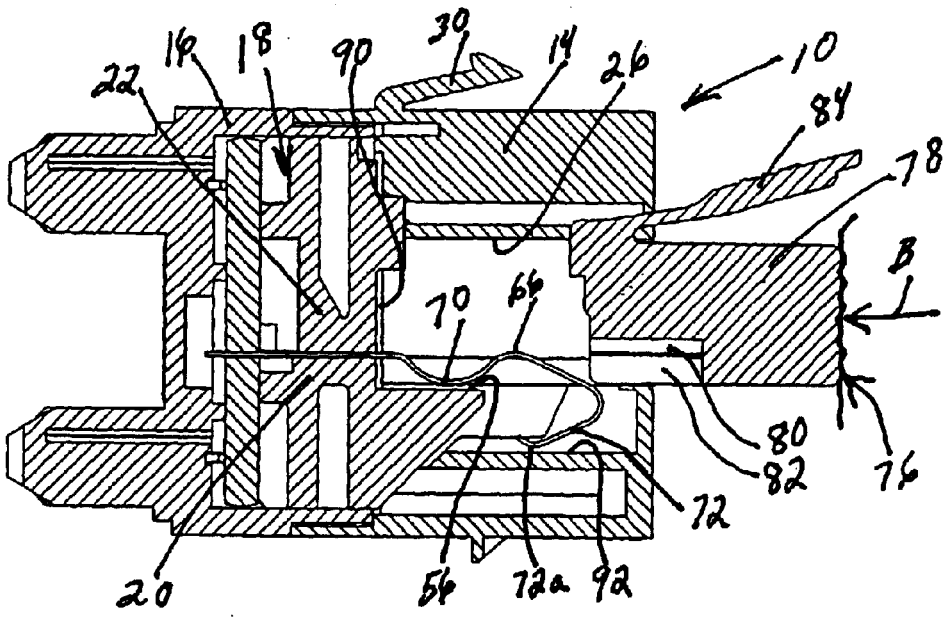
FIG. 9A is a section through the modular jack assembly, with the modular plug about to be inserted into the assembly.

FIG. 9A shows plug 76 about to be inserted into receptacle 26 of modular jack assembly 10 in the direction of arrow "B". One of the outside terminals 24*a*,24*b*,24*g*,24*h* is shown in this depiction. It can be seen that wall 56 of terminal module body half 20 (which forms part of the overall housing means of jack assembly 10) projects forwardly from an interior mating face 90 of the jack housing means. In addition, a second interior wall 92 of front housing part 14 also projects generally parallel with first wall 56, generally perpendicular to interior mounting face 90. It can be seen that the convex surface of bowed engaging portion 70 of the terminal opposes first wall 56, and convex surface 72*a* of the bent-back portion 72 of the terminal opposes second wall 92.

Figure 9B:
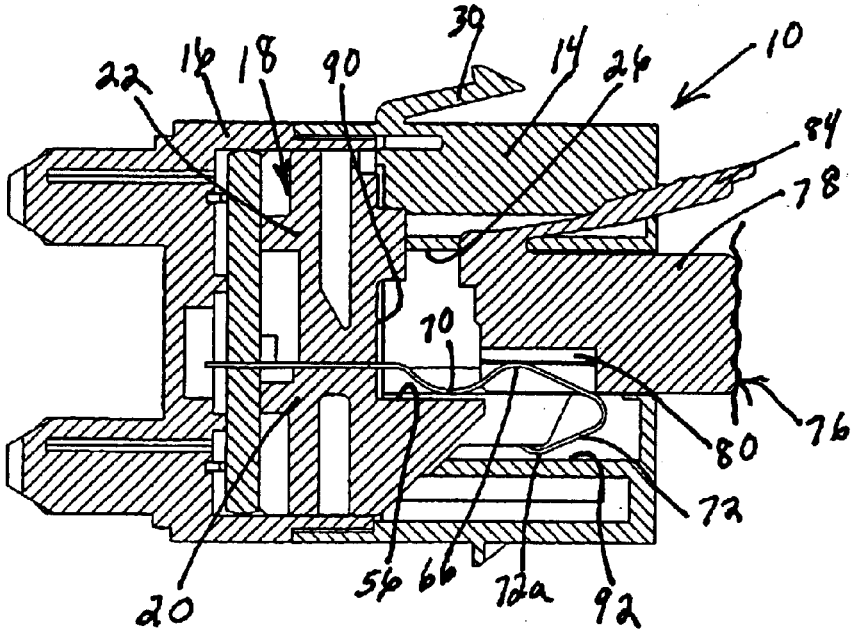
FIG. 9B is a view similar to that of FIG. 9A, but showing an eight-wire plug inserted into the modular jack assembly.

FIG. 9B shows plug 76 inserted into receptacle 26 with one of the contacts 80 on the plug engaging contact portion 66 of the terminal. This causes the terminal to flex only a sufficient amount to establish a positive electrical connection between the terminal and contact 80 of the plug. The depiction of FIG. 9B represents a situation where plug 76 is an eight-wire plug. In other words, contacts 80 (FIG. 8) would be disposed in troughs 82 substantially along the entire width of side 78*a* of the front of the plug, so that all eight contacts will engage the eight terminals 24*a*–24*h* of the jack assembly.

Figure 9C:
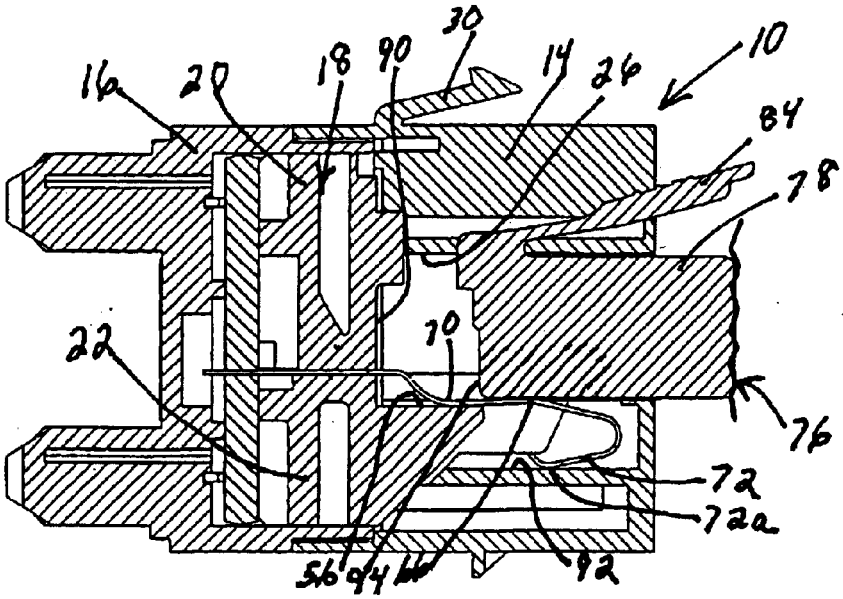
FIG. 9C is a view similar to that of FIG. 9B, but showing the four-wire plug of FIG. 8 inserted into the modular jack assembly.

Now, referring back to FIG. 8, it can be seen that modular plug 76 is a four-wire plug, resulting in only four contacts 80 disposed within four troughs 82. This creates rather sizable plastic corners or shoulders 94 at the front mating face of the modular plug. FIG. 9C shows the situation where the four-wire modular plug 76 of FIG. 8 is inserted into receptacle 26 of modular jack assembly 10. It can be seen that plastic corners 94 of the plug will engage and considerably flex the outside terminals. In order to prevent overflexing of the terminals which might result in establishing permanent sets in the terminals, it can be seen that bowed engaging portion 70 (compare to FIGS. 9A and 9B) has engaged first wall 56 and the convex surface 72*a* of bent-back portion 72 has engaged second wall 92, while contact portion 66 engages corner 94 of housing 78 of plug 76. These counteracting forces on the terminal tend to straighten the terminal out as can be seen in comparing FIG. 9C with FIG. 9B, rather than bending or flexing the terminal excessively which could damage the terminal or create a permanent set in the terminal.

Although the function of the outside terminals were described above in relation to FIG. 9C, in regard to a four-wire modular plug 76 shown in FIG. 8, the same result would occur during mating of a six-wire modular plug. The only difference is that only the outermost terminals 24*a* and 24*h* would engage the plastic corner 94 of the plug when mating with the six-wire plug.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A modular jack assembly, comprising:

a dielectric housing means having a mating face;

at least one conductive terminal having a body portion mounted in the housing means and a contact arm cantilevered from the mating face of the housing means, the contact arm having a contact portion near a distal end thereof for engaging a contact of an appropriate mating connecting device to flex the contact arm in a direction generally parallel to said mating face, and the contact arm having an engaging portion located between the contact portion and the body portion; and said housing means having a first wall for engaging the engaging portion of the terminal and a second wall for engaging the contact portion of the terminal to prevent overflexing of the contact arm, the contact portion of the contact arm being bent back onto itself to define a convex surface at a back side of the contact arm for engaging the second wall of the housing and a contact surface at a front side of the contact arm for engaging the contact of the mating connecting device.

2. The modular jack assembly of claim 1 wherein said first and second walls are generally parallel to each other and project generally perpendicular to the mating face of the housing means.

3. The modular jack assembly of claim 1 wherein said engaging portion of the contact arm comprises a bowed portion defining a convex surface for engaging the first wall of the housing means.

4. The modular jack assembly of claim 1 wherein said first wall projects from the mating face of the housing means offset from the contact arm a first distance, and the second wall projects from the mating face offset from the contact arm a second distance.

5. The modular jack assembly of claim 1, including a plurality of conductive terminals adjacent one another on the housing means, with at least one of said conductive terminals being located at each opposite end of the linear terminal array.

6. The modular jack assembly of claim 1 wherein said housing means include an inner terminal module body in which said terminal is mounted and which defines said mating face, and an outer housing defining at least one of said first and second walls.

7. The modular jack assembly of claim 6 wherein said first wall is provided on the inner terminal module body and said second wall is provided on the outer housing.

8. A modular jack assembly, comprising:

a dielectric housing means having a mating face;

at least one conductive terminal having a body portion mounted in the housing means and a contact arm cantilevered from the mating face of the housing means, the contact arm having a contact portion near a distal end thereof for engaging a contact of an appropriate mating connecting device to flex the contact arm in a direction generally parallel to said mating face, and the contact arm having an engaging portion located between the contact portion and the body portion;

said housing means having a first wall for engaging the engaging portion of the terminal and a second wall for engaging the contact portion of the terminal to prevent overflexing of the contact arm, said first and second walls being generally parallel to each other and projecting generally perpendicularly to the mating face of the housing means; and said engaging portion of the contact arm comprising a first bowed portion defining a convex surface for engaging the first wall of the housing means, said contact portion of the contact arm comprising, at least in part, a second bowed portion defining a convex surface for engaging the second wall of the housing means, said contact portion of the contact arm is bent back onto itself to define the convex surface of second bowed portion at a back side of the contact arm, with a contact surface at a front side of the contact arm for engaging the contact of the mating connecting device.

9. The modular jack assembly of claim 8 wherein said first wall projects from the mating face of the housing means offset from the contact arm a first distance, and the second wall projects from the mating face offset from the contact arm a second distance.

10. The modular jack assembly of claim 8, including a plurality of conductive terminals adjacent one another on the housing means, with at least one of said conductive terminals being located at each opposite end of the linear terminal array.

11. The modular jack assembly of claim 8 wherein said housing means include an inner terminal module body in which said terminal is mounted and which defines said mating face, and an outer housing defining at least one of said first and second walls.

12. The modular jack assembly of claim 11 wherein said first wall is provided on the inner terminal module body and said second wall is provided on the outer housing.

13. A modular jack assembly, comprising:

a dielectric housing means having a mating face;

at least one conductive terminal having a body portion mounted in the housing means and a contact arm cantilevered from the mating face of the housing means, the contact arm having a contact portion near a distal end thereof for engaging a contact of an appropriate mating connecting device to flex the contact arm in a direction generally parallel to said mating face, and the contact arm having an engaging portion located between the contact portion and the body portion; and said housing means having a wall projecting generally perpendicular to the mating face of the housing means for engaging the engaging portion of the terminal, and the engaging portion comprising a bowed portion defining a convex surface for engaging the wall, said housing means further including an inner terminal module body in which said terminal is mounted and which defines said mating face, and an outer housing defining said wall for engaging the engaging portion of the terminal.

14. The modular jack assembly of claim 13, including a plurality of conductive terminals adjacent one another on the housing means, with at least one of said conductive terminals being located at each opposite end of the linear terminal array.

* * * * *